US009180999B2

(12) United States Patent
Castro

(10) Patent No.: US 9,180,999 B2
(45) Date of Patent: Nov. 10, 2015

(54) PERFORATED BAGS

(71) Applicant: Deja S. Castro, Menifee, CA (US)

(72) Inventor: Deja S. Castro, Menifee, CA (US)

( * ) Notice: Subject to any disclaimer, the term of this patent is extended or adjusted under 35 U.S.C. 154(b) by 148 days.

(21) Appl. No.: 13/968,749

(22) Filed: Aug. 16, 2013

(65) Prior Publication Data

US 2015/0049961 A1 Feb. 19, 2015

(51) Int. Cl.
*B65D 33/00* (2006.01)

(52) U.S. Cl.
CPC ..... *B65D 33/001* (2013.01)

(58) Field of Classification Search
CPC .... B65D 33/001; B65D 33/002; B65D 31/12; B65D 81/3261; B65D 33/2566
USPC ..... 383/37, 38, 40; 206/554, 820
See application file for complete search history.

(56) References Cited

U.S. PATENT DOCUMENTS 1,089,629 A * 3/1914 Dittgen ..... B65D 31/12 383/37
2,688,435 A * 9/1954 Vogt ..... B31F 1/205 229/69
2,715,493 A * 8/1955 Vogt ..... B65D 33/001 206/527
3,380,579 A * 4/1968 Pinto ..... 206/493
4,106,733 A * 8/1978 Walitalo ..... B65B 67/1266 206/554
4,106,734 A * 8/1978 Walitalo ..... B65B 67/1266 206/554
4,669,251 A * 6/1987 Inagaki ..... B65D 33/14 206/554
4,696,403 A * 9/1987 Hoover ..... 383/37
4,759,639 A * 7/1988 DeMatteis ..... 383/7
4,802,582 A 2/1989 Johnson
4,849,090 A 7/1989 Case et al.
4,981,216 A * 1/1991 Wilfong, Jr. ..... 206/554
5,018,876 A * 5/1991 Mennella ..... 383/1
5,020,750 A * 6/1991 Vrooman et al. ..... 248/97
5,050,713 A * 9/1991 Lee ..... 190/108
5,170,957 A 12/1992 Carpenter
5,246,119 A * 9/1993 Heffner ..... 209/702
5,248,040 A * 9/1993 DeMatteis et al. ..... 206/554
5,467,572 A 11/1995 Wile et al.
5,469,970 A * 11/1995 Li ..... 206/554
5,662,225 A 9/1997 DeMatteis
5,924,573 A * 7/1999 Piraneo ..... A47F 9/042 206/554
5,967,662 A * 10/1999 Chew ..... B31B 19/98 206/554
5,967,663 A * 10/1999 Vaquero et al. ..... 383/35
5,979,655 A * 11/1999 Tseng ..... B65D 33/001 206/554
6,036,363 A * 3/2000 Behnk ..... 383/38
6,079,877 A * 6/2000 Chew ..... B65D 33/001 206/554
6,113,269 A * 9/2000 DeMatteis et al. ..... 383/103
6,142,302 A * 11/2000 Requena ..... B31B 19/62 206/554

(Continued)

FOREIGN PATENT DOCUMENTS

EP 0433689 B1 10/1993
EP 2000419 A 12/2008
JP 10035749 A 10/1998

*Primary Examiner* — Jes F Pascua
*Assistant Examiner* — Peter Helvey
(74) *Attorney, Agent, or Firm* — The Law Firm of Andrea Hence Evans, LLC

(57) ABSTRACT

The invention features a series of bags having perforations on the front and back panels that connect the back portion of one bag with the front portion of a second bag. The bags are aligned and features holes that are adapted to be received by a stand to support the bags. The bags are packaged and ready to load in a ready to use position. When the bags are separated from each other, the next bag in the continuous series will align and expand to open into a use position. The bags can be stacked on top of each other in a ready to use position.

17 Claims, 7 Drawing Sheets

(56) References Cited

U.S. PATENT DOCUMENTS

| | | | | |
|---|---|---|---|---|
| 6,171,226 | B1 * | 1/2001 | DeMatteis | 493/227 |
| 6,264,035 | B1 * | 7/2001 | Petrie | B65D 33/001 206/554 |
| 6,286,681 | B1 * | 9/2001 | Wilfong, Jr. | B65D 33/001 206/554 |
| 6,422,753 | B1 * | 7/2002 | Thomas | 383/209 |
| 6,435,350 | B1 * | 8/2002 | Huang | B26D 3/12 206/554 |
| 6,502,371 | B2 * | 1/2003 | DeMatteis | 53/459 |
| 6,715,260 | B1 * | 4/2004 | DeMatteis | 53/390 |
| 7,128,251 | B1 | 10/2006 | Galle | |
| 2001/0029724 | A1 * | 10/2001 | DeMatteis | B65B 43/14 53/459 |
| 2002/0020648 | A1 * | 2/2002 | Lam et al. | 206/390 |
| 2002/0074260 | A1 * | 6/2002 | Huang | B31B 19/98 206/554 |
| 2002/0108882 | A1 * | 8/2002 | DeMatteis | A47F 9/042 206/554 |
| 2003/0136793 | A1 * | 7/2003 | Chen | B65D 83/0805 221/63 |
| 2004/0255558 | A1 | 12/2004 | Rabiea | |
| 2007/0295637 | A1 * | 12/2007 | Ho | B65D 33/007 206/554 |
| 2008/0035522 | A1 * | 2/2008 | Tan | B31B 19/16 206/554 |
| 2008/0041908 | A1 | 2/2008 | Daniels | |
| 2009/0162496 | A1 | 6/2009 | Henderson et al. | |
| 2009/0236345 | A1 | 9/2009 | Mack-Robles et al. | |
| 2010/0276427 | A1 | 11/2010 | Kaberna | |
| 2011/0075951 | A1 | 3/2011 | Tseng | |
| 2012/0160732 | A1 * | 6/2012 | Tan | B31B 19/36 206/554 |

* cited by examiner

PERFORATED BAGS

FIELD OF THE INVENTION

The present invention relates, in general, to a series of bags and more particularly to a series of bags joined to each other via perforations along the front and back portion of the bags.

BACKGROUND OF THE INVENTION

Plastic bags are often used to transport items such as groceries or to store garbage. These bags should have a high load-carrying capacity, be simple and strong. Many stores offer bags at the checkout counter to customers. However, the bags often take additional time to remove because the bags are difficult to open. Also, the bags easily slip and are typically misaligned on their storage racks or in their storage containers. The bags waste space during storage and take time to position them on holders.

SUMMARY OF THE INVENTION

The present invention provides series of bags joined to each other via perforations along the front and back portion of the bags which provides easy opening and storage of the bags.

An aspect of an embodiment of the invention provides the series of bags connected in a manner such that the connection exerts a pressure on the bags that helps to align the bags.

A further aspect of an embodiment of the invention features holes on the bags that are adapted to be received by a stand to support the bags.

A further aspect of an embodiment of the invention features the series of bags connected in a manner such that the connection expands the folds of the bags to put the bags in an open position and ready for use.

Additional aspects, objectives, features and advantages of the present invention will become apparent from the following description of the preferred embodiments with reference to the attached drawings.

DETAILED DESCRIPTION OF THE INVENTION

Figure 1:
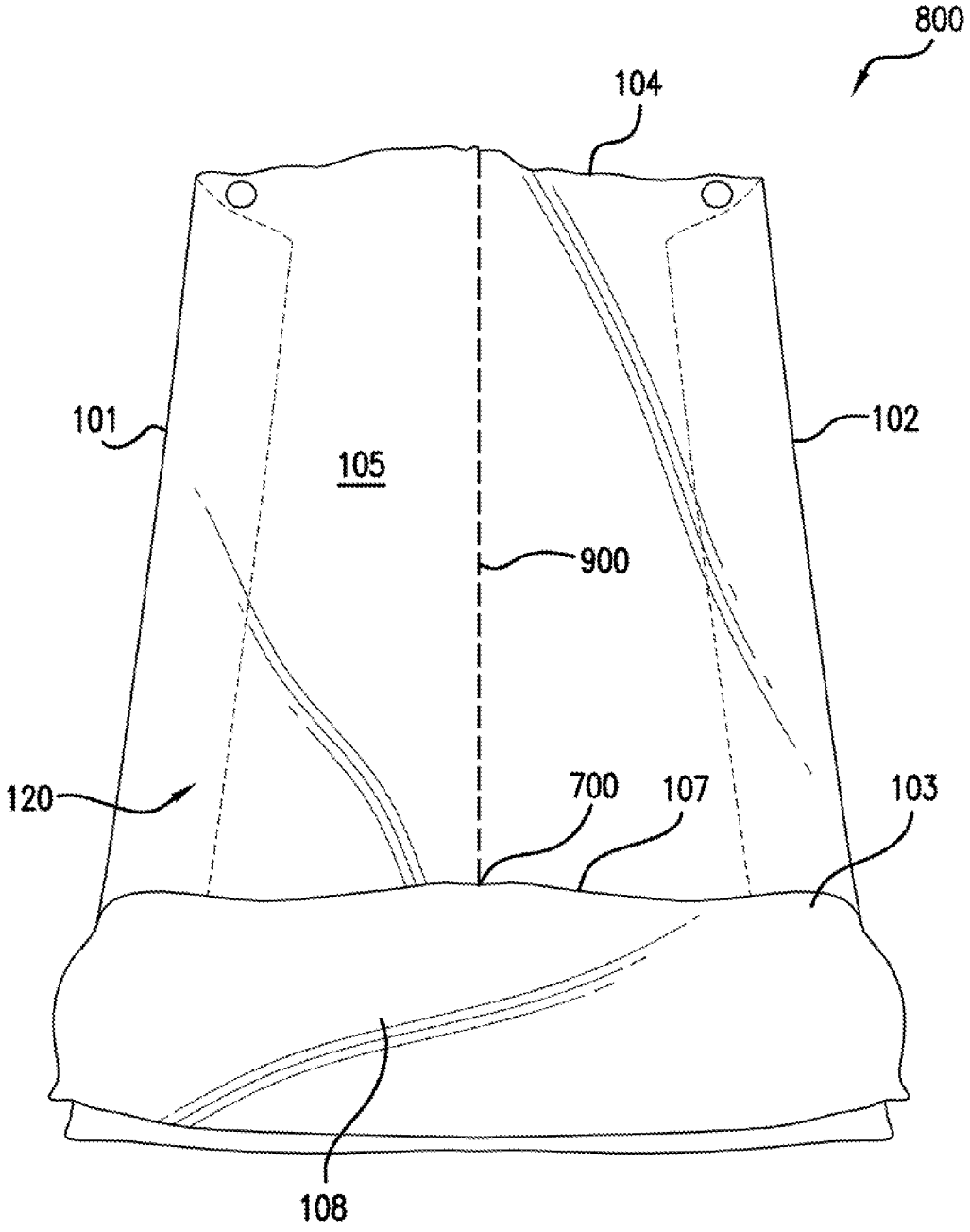
FIG. 1 is a perspective view of a closed bag showing the left side panel and right side panel tucked in and the bottom of the bag folded upwards.
Figure 2:
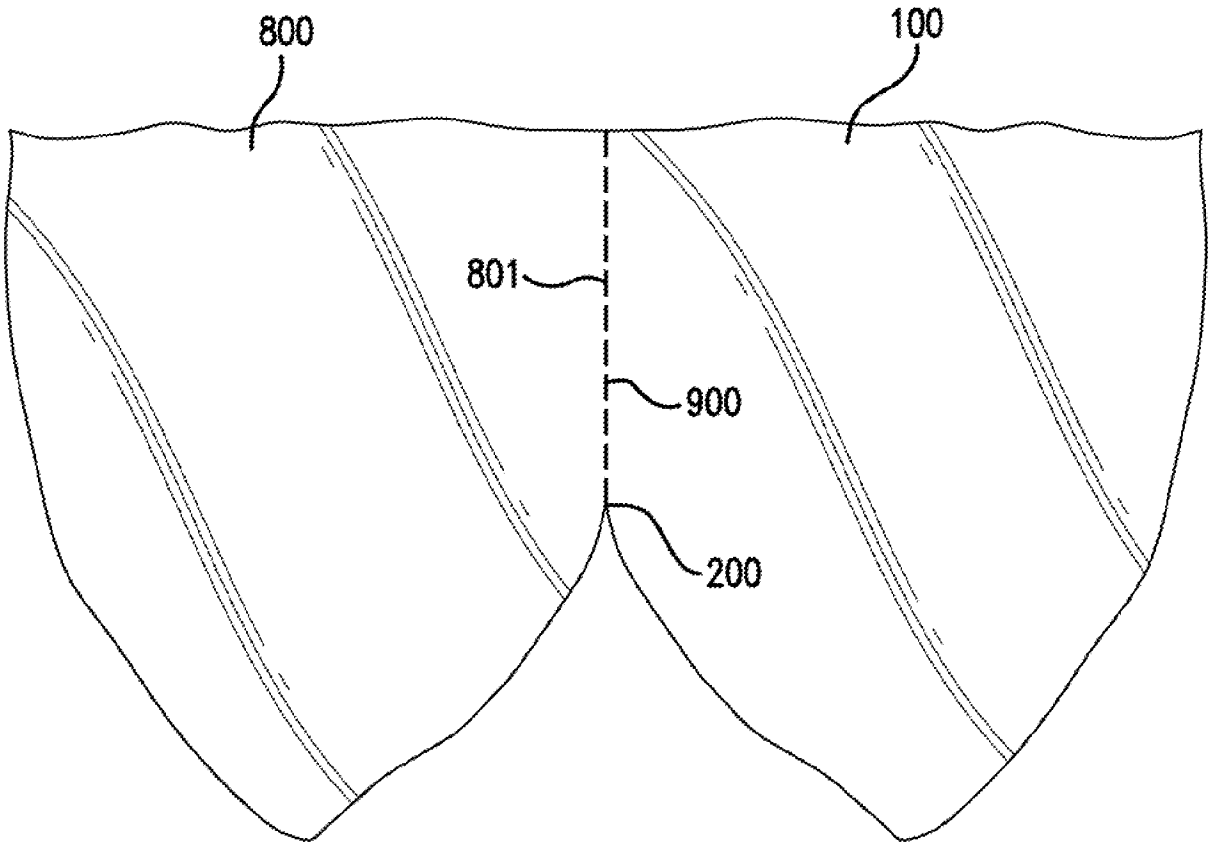
FIG. 2 is an illustration of a first and second bag flattened and connected by a perforation on the back panel of the first bag and the perforation on front panel of the second bag.

FIG. 1 is a perspective view of a closed first bag 800 showing the left side panel 501 and right side panel 504 tucked in and the bottom 103 of the bag folded upwards towards the top 104 of the bag. A first bag 800 and a second bag 100 are described; however, the continuous series of bags, as shown in FIG. 2, have the same features and functions. FIG. 2 is an illustration of a first 800 and second bag 100 flattened and connected by a perforation 801 on the back panel of the first bag and the perforation 900 on front panel of the second bag.

Figure 4:
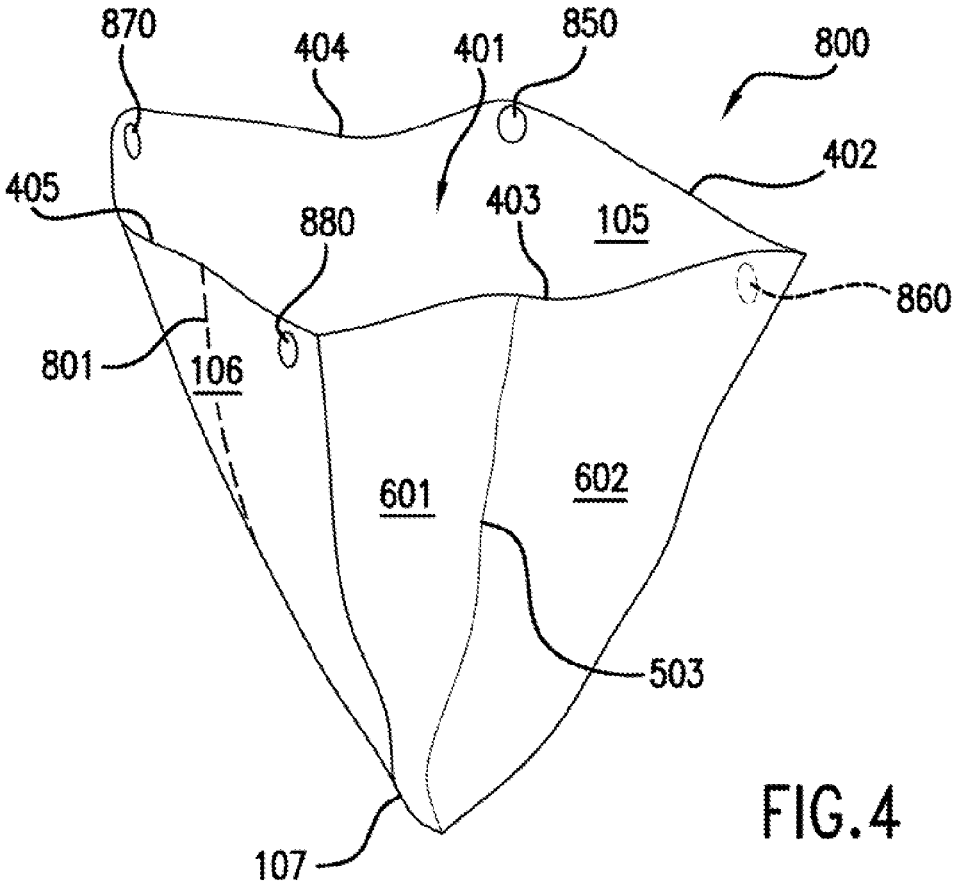
FIG. 4 is a perspective side view of the bag in an open position.

The bags are preferably made from a plastic film. However, alternate known lightweight materials such as soft and flexible LDPE (Low Density Polyethylene) or, for strength, LLDPE (Linear Low Density Polyethylene) or HDPE (High Density Polyethylene) may be used. Biodegradable film can also be used. The top 104 of the bag has an open mouth end 401. FIG. 4 is a perspective side view of the bag 800 in an open position. The bag 800 features a top front panel 105, a back panel 106, left side 101 and a right side 102. The top front panel edge 402 on the top front panel 105, the top left side panel edge 403, the top right side panel edge 404 and the top back panel edge 405 form the open mouth end 401. Items can be placed into the open mouth end 401 and supported by the bag 800. For example, groceries or trash can be deposited in the open mouth end 401 and stored in the bag 800. The bottom 103 of the bag 800 has a closed bottom end 107. As items are placed into the bag, the items do not exit the bag at the bottom end 107 since the bottom end 107 is closed. Items can enter and exit the bag through the open mouth end 401.

Figure 5:
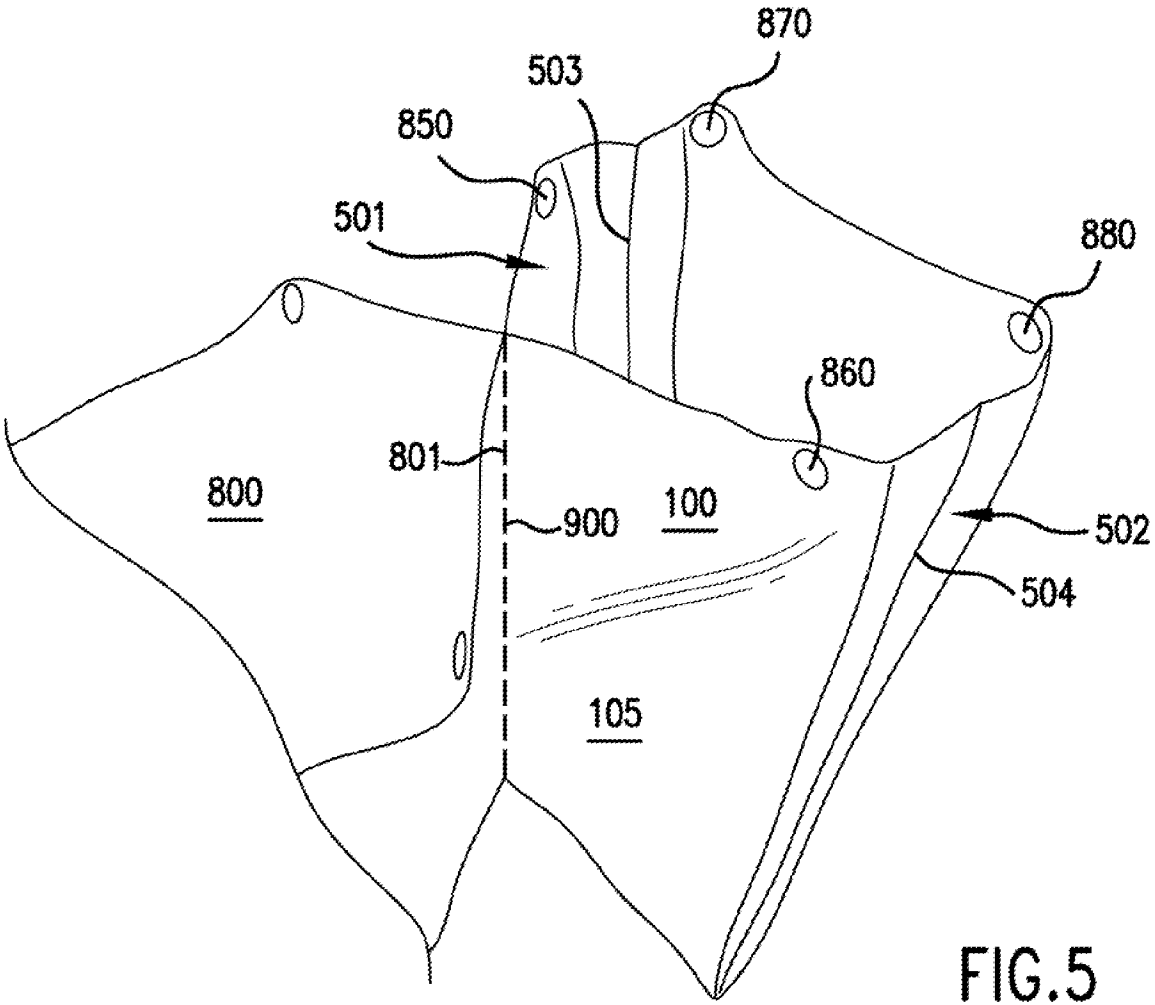
FIG. 5 is an illustration of the second bag opening from the motion of the first bag being removed.
Figure 6:
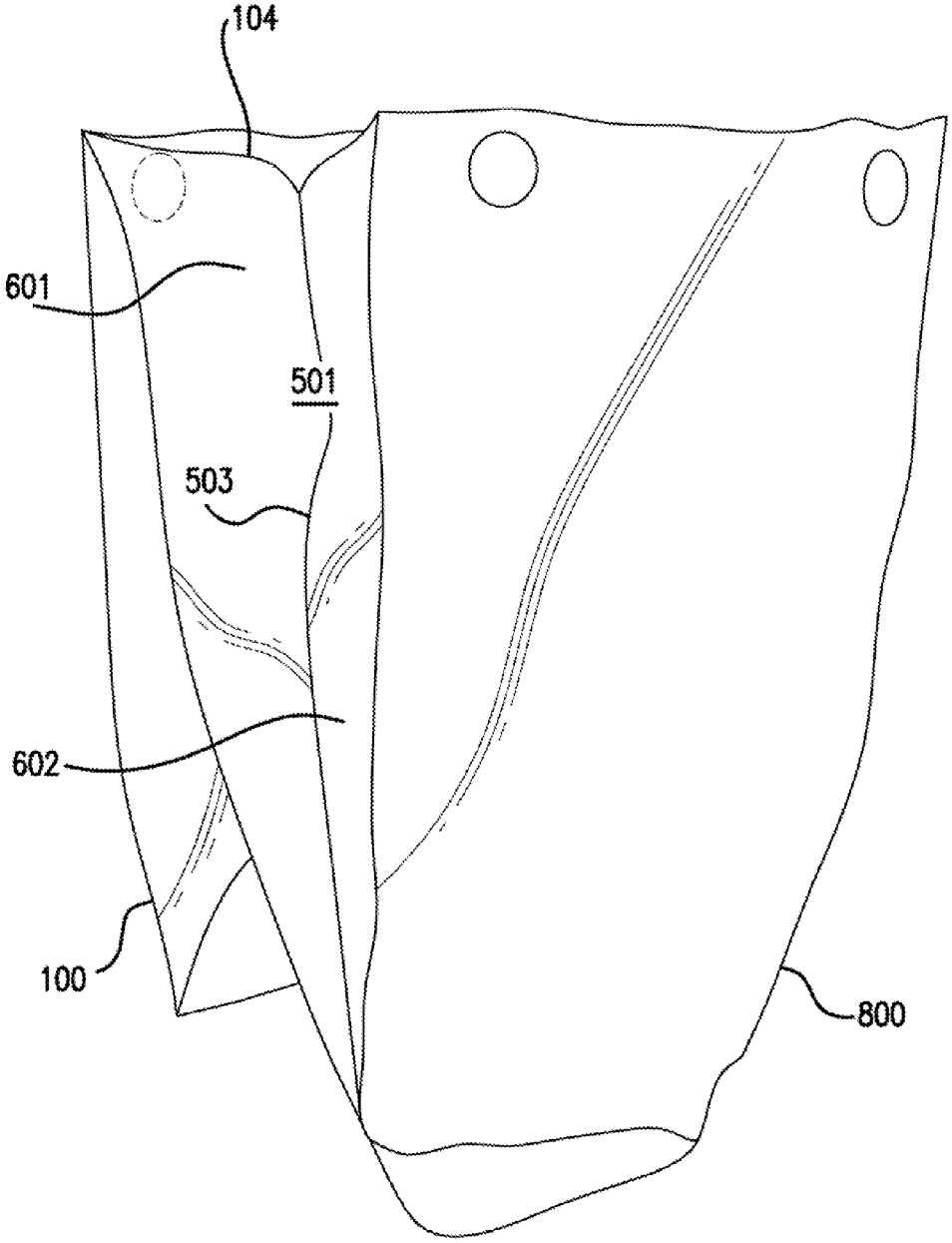
FIG. 6 is a perspective view of the connected first and second bag with a tucked in side panel on the first bag.
Figure 7:
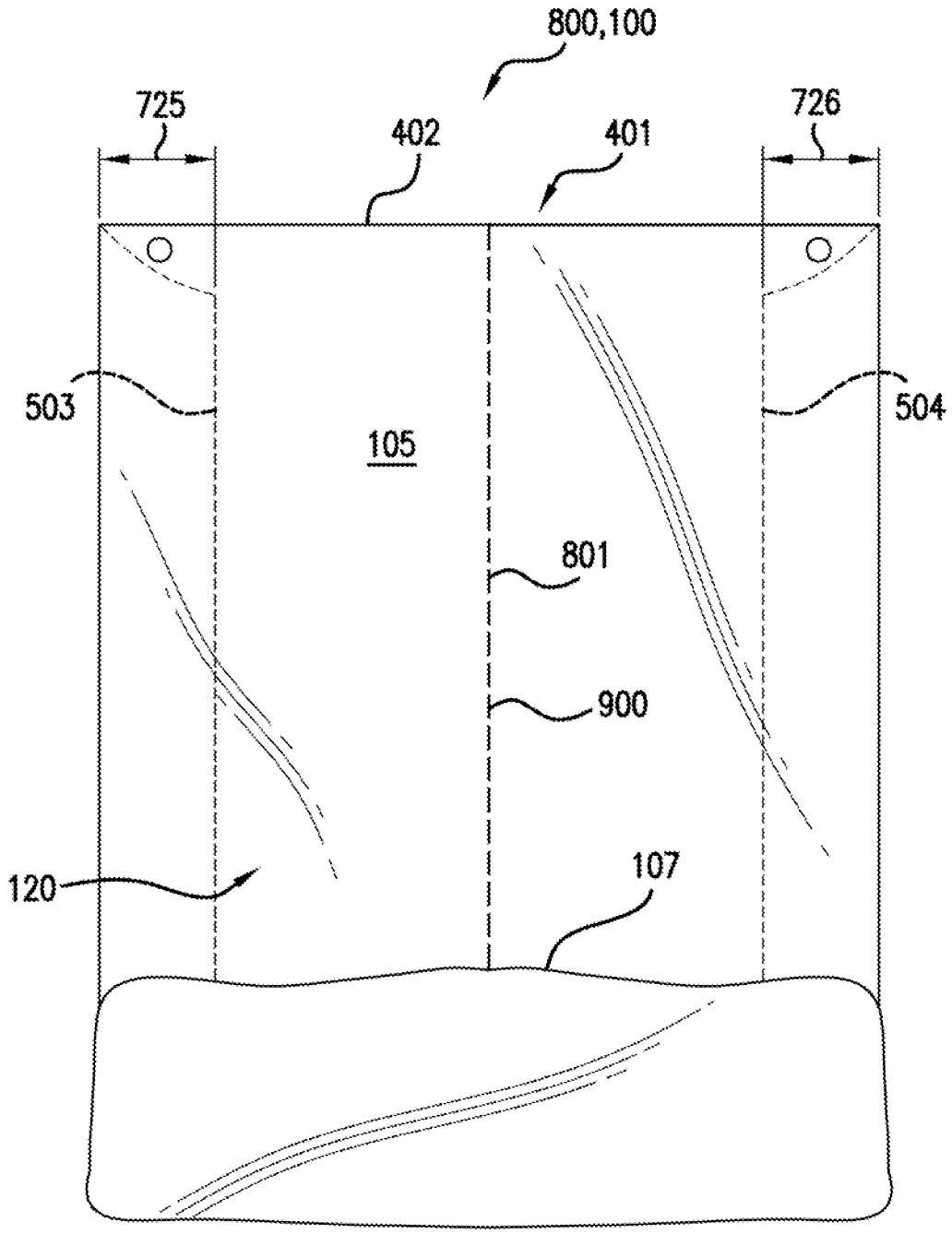
FIG. 7 is a front view of stacked bags.

The film extending from the top left side panel edge 403 to the bottom end 103 of the bag forms a left side panel 501, shown in FIG. 5. FIG. 5 is an illustration of the second bag opening as the first bag is separated from the second bag. The film extending from the top right side panel edge 404 to the bottom end 103 of the bag forms a right side panel 502. The left side panel 501 and right side panel 502 are the left and right sides of the bag, respectively. A first fold line 503 along the left side of the bag 101 centered on the left side panel 501 extends from the open mouth end 401 left side edge 403 to the closed bottom end 107. The first fold line 503 divides the left side panel 501 in half. The right side panel 502 features a second fold line 504 along the right side 102 of the bag centered on the right side panel 502. The second fold line 504 extends from the open mouth end 401 right side edge 404 to the closed bottom end 107. The second fold line 504 divides the right side panel 502 in half. The left side panel 501 is tucked or folded in along the first fold line 503 such that the left side panel 501 is divided equally between the first fold line 503 into a first left side panel half 601 and a second left side panel half 602, shown in FIG. 6. FIG. 6 is a perspective view of the connected first and second bag with a tucked in side panel on the first bag. The right side panel 502 is tucked in along the second fold line 504 such that the right side panel 502 is divided equally between the second fold line 504 into a first right side panel half 410 and a second right side panel half 411. The left side panel 501 and right side panel 502 tucked in portion forms a middle layer between the front panel 105 and back panel 106 when the bags are in a folded position since the tucked in areas are between the front and back panels. FIG. 7 is a front view of stacked bags, 800 and 100. Tucked in left middle layer 725 extends from the left sides of the front and back panel to about ¼ to ½ across the front and back panels. Tucked in right middle layer 726 extends from the right sides of the front and back panel to about ¼ to ½ across the front and back panels. The middle layer's first fold line 503 and the second fold line 504 expand so that the front panel and back panel of the bag move apart from each other to open the bag.

The front panel 105 is the film on the front side 120 of the bag. The front panel 105 is the film above first and second fold lines 503, 504 on the top surface of the bag. The front panel extends the entire length from the bottom end 107 to the open mouth end 401. The back panel 106 is the film on the back side 300 of the bag. The back panel 106 is the film below the first and second fold lines 503, 504 on the bottom surface of the bag. The bottom panel extends the entire length from the bottom end 107 to the mouth end 401.

Figure 3:
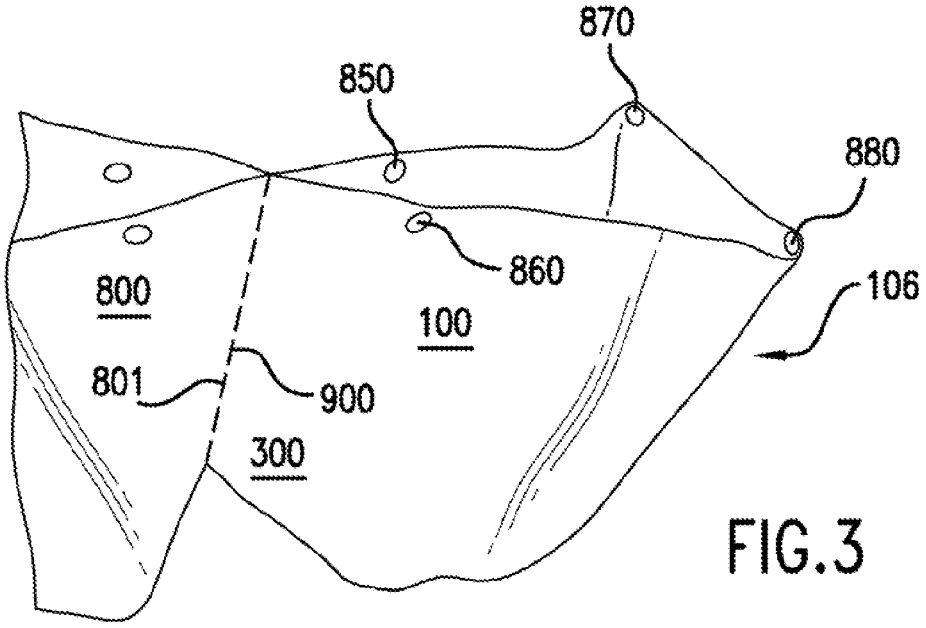
FIG. 3 is a perspective side view of the first and second bags connected by perforations with the second bag in an open position.

The front panel 105 features front perforation 900 extending from the top of the front panel edge 402 to the middle area 200 of the front panel 105. The middle area 200 is about half the length of the bag to allow the bottom end 107 of the bag to fold upwards making the bag shorter for folding, packaging and storing purposes. The folded bottom area 108 of the bag is shown in FIG. 1. The front perforation 900 is a vertical line of small holes centered on the front panel of the bag. The front perforation 900 aids in separating the first bag from the previous bag and so on. The folded bottom area 108 is preferably folded to the bottom end 700 of the perforation. The folded bottom area 108 does not interfere with the perforated area and will unfold as items are added to the bag. The bags are connected in a continuous series. A first bag 800, has a back perforation 801 extending vertically from the top edge of the first bag's top of the back panel edge 405 to the middle area 200 of the back panel 106. The back perforation 801 of the first bag 800 aligns with the front perforation 900 of the second bag. The perforations 801, 900 are the same length. The back perforation 801 is a vertical line of small holes centered on the back panel 106 of the first bag 800. The back perforation 801 of first bag 800 is connected to the front perforation 900 of the second bag 100, as shown in FIG. 3. The front and back perforations 900, 801 are substantially centered on the front and back panels, respectively. FIG. 3 is a perspective side view of the first 800 and second bags 100 connected by perforations 900, 801 with the second bag 100 in an open position. When a pressure is exerted to remove the first bag, the connected first and second bags disengage at the front and back perforations. The front panel of the second bag opens or moves away from the back panel as the first bag is separated from the second bag.

Figure 8:
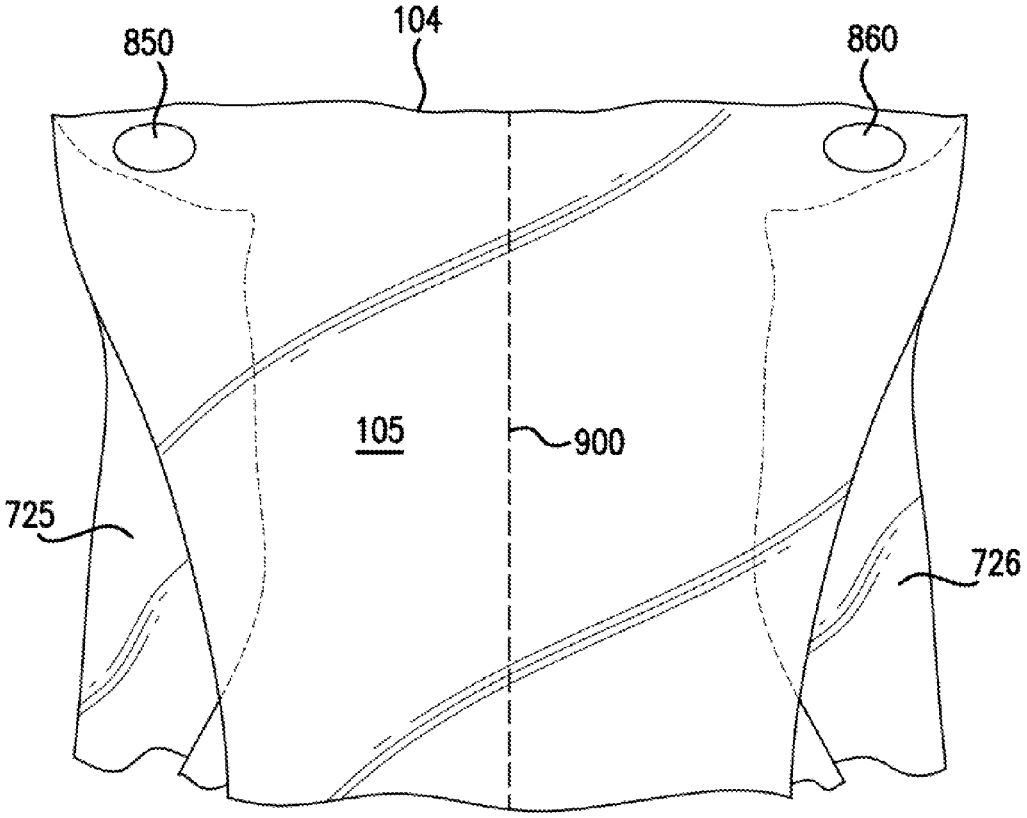
FIG. 8 is a front view of a bag showing the perforation and first and second front panel holes.

FIG. 8 is a front view of a bag showing the perforation 900 and first and second front panel holes 850, 860. A first front panel hole 850 and a second front panel hole 860 are located substantially near a top edge area 104 of the front panel 105. The holes are preferably circular and of a size to be received by a holder such as parallel bars or arms, for example. The holes are sized to receive arms that guide the bags along them. On the back panel 106, a first back panel hole 870 and a second back panel hole 880 substantially near a top edge area 405 of the back panel. The holes 850, 860 are aligned with the holes 870, 880. The first front panel hole 850 and the second front panel hole 860 are to left and right of the front perforation 900 and the first back panel hole 870 and the second back panel hole 880 are to left and right of the back perforation 801. The holes are only through the front and back panels such that when the bags are positioned on a holder, the left top edge 403 and right top edge 404 are not received by a holder and so that they are free to expand to receive items. The holder does not extend through the left top edge and right top edge.

The bags are designed to be loaded on a bar design rack. They are packaged in a way that allows multiple bags to be stored in a ready to use position. While removing the first bag, the first bag's back perforation 801 will pull on the connected second bag's front perforation 900 causing the second bag to open. The user can disconnect the bags along the perforations 801, 900. The folded lines will expand as the first bag is opened making the bag ready to use. The bags will take up less space when stored since they can be stored in a ready to use stacked position, as described. The second bag will be in an open and ready to use position.

The invention has been described in detail with particular reference to certain preferred embodiments thereof, but it will be understood that variations and modifications can be effected within the spirit and scope of the invention.

The invention claimed is:

1. A continuous series of bags comprising, at least a first and a second bag each having an open mouth end, closed bottom end, a left side panel, a right side panel, a front panel on a front side of the bag, wherein the front panel extends from the bottom end to the mouth end, a back panel on the back side of the bag wherein, the back panel extends from the bottom end to the mouth end, wherein the front panel features a vertically positioned front perforation, wherein the back panel features a vertically positioned back perforation, wherein the vertically positioned back perforation of the first bag is connected to the vertically positioned front perforation of the second bag between the front and back panels, respectively and wherein the front panel and the back panel of each of the first and second bags are free of the front perforation and back perforation, respectively, once the first bag has been separated from the second bag.

2. The continuous series of bags of claim 1, wherein the front perforation extends from the top of the front and to the middle area of the front panel.

3. The continuous series of bags of claim 1, wherein the back perforation extends from the top of the back panel to the middle area of the back panel.

4. The continuous series of bags of claim 1, wherein the left side panel is tucked in along a first fold line such that the left side panel is divided equally between the first fold line.

5. The continuous series of bags of claim 4, wherein the right side panel is tucked in along a second fold line such that the right side panel is divided equally between the second fold line.

6. The continuous series of bags of claim 5, wherein the left side panel and right side panel tucked in portion forms a middle layer between the front panel and back panel 'when the bags are in a folded position.

7. A continuous series of bags comprising:

at Least a first and a second bag each having an open mouth end, closed bottom end, a left side panel having a first fold line extending along the left side of the bag from the open mouth end to the closed bottom end, a right side panel having a second fold line extending along the right side of the bag from the open mouth end to the closed bottom end, wherein the left side panel is tucked in along the first fold line such that the left side panel is divided equally between the first fold line, wherein the right side panel is tucked in along the second fold line such that the right side panel is divided equally between the second fold line, a front panel on a front side of the bag formed on the top sides of the first and second fold lines, the front panel extending from the bottom end to the mouth end, a back panel on the back side of the bag formed on the bottom sides of the fold line first and second fold lines, the back panel extending from the bottom end to the mouth end, wherein the front panel features a vertically positioned front perforation along the top of the front panel to the middle area of the front panel, wherein the back panel features a vertically positioned back perforation along the top of the back panel to the middle area of the back panel, and wherein the vertically positioned back perforation of the first bag is connected to the vertically positioned front perforation of the second bag between the front and back panels, respectively and wherein the front panel and the back panel of each of the first and second bags are free of the front perforation and back perforation, respectively, once the first bag has been separated from the second bag.

8. The continuous series of bags of claim 7, further comprising a first front panel hole and a second front panel hole substantially near a top edge area of the front panel.

9. The continuous series of bags of claim 8 further comprising a first back panel hole and a second back panel hole substantially near a top edge area of the back panel.

10. The continuous series of bags of claim 9, wherein the first front panel hole and the second front panel hole are to left and right of the front perforation and the first back panel hole and the second back panel hole are to left and right of the back perforation.

11. The continuous series of bags of claim 7, wherein the front and back perforations are substantially centered.

12. The continuous series of bags of claim 7, wherein the left side panel and right side panel tucked in portion forms a middle layer between the front panel and back panel when the bags are in a folded position.

13. The continuous series of bags of claim 7, wherein when a pressure is exerted to remove the first bag, the connected first and second bags disengage at the front and back perforations.

14. The continuous series of bags of claim 7, wherein the open month end of the second bag opens as the first bag is separated from the second bag.

15. A continuous series of bags comprising, at least a first and a second bag each having an open mouth end, closed bottom end, a left side panel, a right side panel, a front panel on a front side of the bag, wherein the front panel extends from the bottom end to the mouth end, a back panel on the back side of the bag, wherein the back panel extends from the bottom end to the mouth end, a pair of front panel holes on the front panel, a pair of back panel holes on the back panel, wherein the front panel features a front perforation, wherein the back panel features a back perforation, wherein the back perforation of the first bag is connected to the front perforation of the second bag between the front and back panels, respectively, such that when the first bag is moved away from the second bag, the front panel of second bag moves to an open position and wherein the front panel and the back panel of each of the first and second bags are free of the front perforation and back perforation, respectively, once the first bag has been separated from the second bag.

16. The continuous series of bags of claim 15, wherein the left side panel and right side panel are tucked in along a first fold line and second fold line, respectively.

17. The continuous series of bags of claim 1, further comprising a longitudinal axis extending from the open mouth end to the closed bottom end of the bags, wherein the front or back perforation length is substantially a length from the top of the longitudinal axis defined by the open mouth end to a middle area of the longitudinal axis.

* * * * *